US005980794A

United States Patent [19]

Stegemann et al.

[11] Patent Number: 5,980,794

[45] Date of Patent: Nov. 9, 1999

[54] METHOD OF CONTROLLING COMPACTING BY MEASURING HYDRAULIC FLUID

[75] Inventors: Lutz Stegemann, Gronau; Wilfried Ebrecht, Einbeck; Harald Mueller; Hans-Joachim Grosser, both of Alfeld, all of Germany

[73] Assignee: Kuenkel-Wagner Prozess Technologie GmbH, Germany

[21] Appl. No.: 08/937,674

[22] Filed: Sep. 25, 1997

[51] Int. Cl.[6] ..... B22C 15/08

[52] U.S. Cl. ..... 264/40.4; 164/456; 264/220

[58] Field of Search ..... 264/40.1, 40.4, 264/40.5, 220; 164/456, 150.1, 154.1

[56] References Cited

U.S. PATENT DOCUMENTS

| | | | |
|---|---|---|---|
| 4,376,085 | 3/1983 | Burry | 264/40.4 |
| 4,915,159 | 4/1990 | Damm et al. | 164/456 |
| 5,039,294 | 8/1991 | Gautier et al. | 264/40.5 |
| 5,250,238 | 10/1993 | Kiefer et al. | 264/40.5 |
| 5,409,052 | 4/1995 | Kaneto et al. | 164/456 |
| 5,482,662 | 1/1996 | Nakamura et al. | 264/40.1 |
| 5,486,106 | 1/1996 | Hehl | 264/40.5 |
| 5,618,484 | 4/1997 | Mogensen et al. | 264/220 |

FOREIGN PATENT DOCUMENTS

| | | |
|---|---|---|
| 295472 | 12/1988 | European Pat. Off. . |
| 4112466 | 11/1991 | Germany . |
| 4114362 | 4/1993 | Germany . |
| 4340401 | 6/1994 | Germany . |
| 55-016786 | 2/1980 | Japan . |
| 57-142743 | 9/1982 | Japan . |

*Primary Examiner*—Jill L. Heitbrink

*Attorney, Agent, or Firm*—Duane, Morris & Heckscher, LLP

[57] ABSTRACT

The invention relates a control or regulation of a multipiston squeeze head or block squeeze head of a molding machine for clay-bonded molding sand (molding material). In an active pressing process with a squeeze head moving in downward direction, e. g. consisting of multislides or multipistons, the displacement of individual multislides has so far been detected through by end switches (approach switches) or through inductive stroke transducer. Thus, reached positions are registered and processed in a control means. Subject matter of the invention is an adaptation of influenceable parameters to obtain a sand mold of good quality on a long-term basis. Surprisingly, the measurement of the flown oil ($Q;q_r(t)$) provides a basis for the improvement of the sand mold. If models of different sizes are molded subsequently, the quantity of sand required is different. According to the control signal of the invention ($Q;q_r(t)$), more or less sand is filled into the bunker.

18 Claims, 4 Drawing Sheets

1 Increase of the amount of sand to be filled in.

2 Decrease of the amount of sand to be filled in.

3 Blown oil volume at end of pressing or squeezing.

METHOD OF CONTROLLING COMPACTING BY MEASURING HYDRAULIC FLUID

BACKGROUND OF THE INVENTION

The invention relates to a control or regulation of a multipiston squeeze head or block squeeze head of a molding machine for clay-bonded molding material (e. g. molding sand).

In an active pressing process from above with a squeeze head, e. g. consisting of multislides or multipistons, the displacement of individual multislides or multipistons has so far been detected through main control switches (approach switches) or through inductive stroke transducer. Thus, reached positions are registered and processed in a control means. This kind of position measurement is also possible for the squeeze head—with or without multislides or multipistons—as a whole. At present, two prior art documents are known[1].

Compacting of sand by individually operated pistons by oil flow is disclosed in J-A 57/142743 (Komatsu), "Patent Abstracts of Japan," Vol. 006, No. 246 (M176), Dec. 4, 1992. The control of the filling height of sand in compacting units is subject matter of DE-A 41 12 466 (Georg Fischer), as there are used two switch members to physically detect the filling height of the compacted sand.

SUMMARY OF THE INVENTION

Subject matter of the invention is an adaption of influenceable parameters to obtain a sand mold of good quality on a long-term basis. A constant height of the sand bale as well as a uniform compacting is to be achieved. The squeezing time is to be adapted to achieve a minimum time per sand mold.

According to an aspect of the invention, the parameters are determined and influenced directly at the molding machine by measuring the hydraulic fluid[1] to the compacting unit as a difference in the sense of a derivative[2] with respect to a time as well as in the sense of a quantity[3] in absolute value or its function over time. Surprisingly, the measurement of the hydraulic fluid flow provides a good basis for a controlled or regulated improvement of the sand mold. Said regulation or control may concern a control of the sand quantity in the molding box, a detection of the piston position without sensors arranged close to the pistons, a detection, collection or optimization of the final or end position or the desired end position of the pistons prior to their physical end position for a defined model or pattern ("end of pressing") or a measurement and change of the compactibility of the molding material.

According to a further aspect of the invention, said facilities may be used simultaneously, up to using all said four facilities at the same time.

If models or patterns of different sizes are molded subsequently, the required quantity of sand varies. According to prior art, after changing a pattern or model, a mechanical apparatus for height detection arranged above the molding boxes detects the current filling level of the boxes after squeezing (compare the document of G. Fischer). If said level is too high or too low, the quantity of sand which is made available in the filling station for the subsequent pressing process is corrected correspondingly. Thus, it is guaranteed that after changing a pattern or model, an optimum quantity of sand may again be filled in and compacted (depending on the control signal, more or less sand is filled into the machine bunker).

The inventive method considerably simplifies the mechanical equipment.

Technical devices for a dynamic measurement of the flowing mass (oil flow) operate for example according to the Coriolis principle. This dynamic mass measurement provides a measuring signal which is proportional to the streaming mass (kg/h). Conductivity, density, temperature and viscosity do not influence said measurement.

The measuring principle may be used for the detection of flowed volumes, e. g. of hydraulic oil. Said principle is based on a controlled generation of Coriolis forces. Said forces occur in a system always when a translatory (straight) and simultaneously a rotary (turning around) movement are superimposed.

When practically applying said principle, the rotary movement is replaced by an oscillation. Two straight pipes through which the product flows are oscillated (resonance) and constitute a sort of "tuning fork". The phase relation of the oscillation at the inlet and the outlet is changed differently by the flowed mass, which change is detected by optical sensors. The phase difference is proportional to the flowed mass and is available as a linear standardized output signal. The resonant frequency of the measuring pipes is dependent on the oscillating mass and thus on the product density. A control circuit permits to operate the system always in tune. The product density is then calculated on the basis of the resonant frequency.

The temperature of the measuring pipes is detected for calculatory compensation of temperature effects. This signal corresponds to the product temperature and is also available for external purposes.

A further method for the detection of flowed volumes per time unit is provided by a screw volumeter which operates according to the displacement principle. The flowing oil rotates the spindles (densimeters) in the interior. A frequency signal is provided by inductive approach switches based on said rotary movement. Thus, the conveyed oil quantity per time unit is obtained.

Which kind of measurement "flowed volume" and "flowed volume per time unit" is used depends on the application (Coriolis, Volumeter, piston storage measurement, . . . ). If a contactless, non-wearing measuring principle, insensitive to impulses, is used, best results are obtained.

A correction of the compactibility or a corresponding optimization operates on a long-term basis by addition or stopping of additives or by changing the moisture of the molding sand prior to filling it into the molding box. By detection of the hydraulic fluid gradient, each squeezing (shaping) process provides a new measured value for the compactibility, said value causing a desired modification of the sand. As far as still desired by the control means, it orients itself at a comparison of the desired and the actual value.

The invention also discloses an electronic apparatus for control engineering which the expert uses for applying the method based on the measurement of the hydraulic fluid (flow) or its derivative.

BRIEF DESCRIPTION OF THE FIGURES

Six embodiments of the invention are given on the basis of control methods 1 to 6.

FIG. 1 illustrates an embodiment of control method 1 in which the sand quantity is changed after a model or pattern change to obtain equal heights of the sand bales.

FIG. 2 illustrates an embodiment permitting to detect a piston torn-out after the end of pressing by measuring the oil quantity.

FIG. 3 illustrates an embodiment permitting by measurement of the oil flow to minimize the time required for the manufacture of a sand mold, and also to decrease the consumption of energy.

FIG. 4 illustrates an embodiment of a correction of the compactibility of sand by measuring the change of the oil flow per time interval.

DETAILED DESCRIPTION OF THE INVENTION

Figure 1:
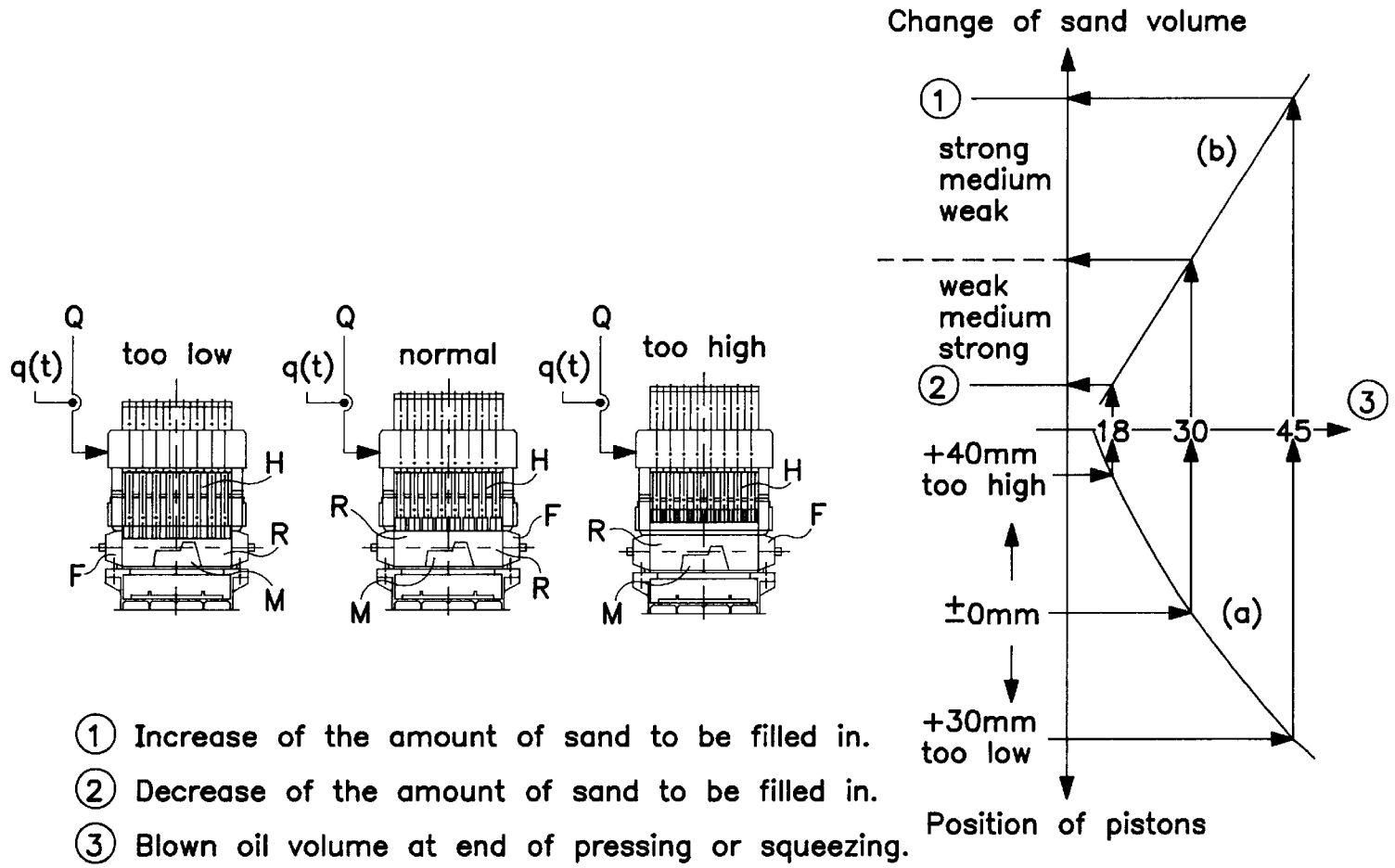
FIG. 1 to FIG. 4 represent embodiments 1 to 4 thereof. In the embodiments, oil is used as hydraulic fluid.

The left half of FIG. 1 schematically illustrates molding or pressing pistons which are connected to a common oil source Q and penetrate into a back of sand R, having different depths (low, normal, high). A model or pattern M is provided on the bottom of the schematically indicated molding box F.

The pistons according to the left partial illustration penetrated too deep into the back of the mold, the pistons according to the right partial-illustration are too high. The pistons according to the middle partial illustration have normal position which is at the upper edge of the molding box. The curves indicated on the right of the three schematic illustrations show the average value "normal", which presents 30 liters of flowed oil, between the returning position of the pistons and the final position "normal" according to the schematic illustration. 45 liters of oil represent a too deep penetration of the left pistons according to the schematic illustration and 16 liters of flowed oil represent the pistons positioned too high. The remaining heights of the sand bales are shown below in the right partial diagram. For 16 liters of oil, the pistons are positioned 40 mm too high; in case of 30 liters of flowed oil, the determined and regulated desired value (=set value) of plus/minus zero is achieved and in case of 45 liters of flowed oil, the pistons penetrate 30 mm too deep into the molding box F.

The quantity of sand according to the upper partial diagram (b) is changed, namely increased or decreased, depending on the measured quantity of oil q(t) which has flowed from the beginning until the end of the pressing process. In the example of 30 liters of oil, said quantity remains unchanged, in the example of 45 liters of oil, it is considerably increased and in the example of only 16 liters of flowed oil, it is considerably decreased.

The change of the sand quantity to achieve equal piston depth in case of a change of the pattern or model, represented in FIG. 1, uses dependencies (a) and (b) according to the two part-diagrams (curves or "functions").

A model or pattern change is a change of one volume of a pattern to another. If the volume of the pattern is changed, the quantity of molding material arrangeable above it in the molding box changes, i. e. if a change from a deep to a high pattern M is made, not as much molding material may be filled into the box to obtain the same final height after the compacting process.

The movement of the multipistons H is measured as a whole through the oil quantity. Said measurement is effected by a measuring arrangement as described above (Coriolis, volumeter, piston measurement). At the end of the pressing process, the actual quantity of flowed oil is recorded. If a large quantity of oil has flowed, the pistons H are at a low position, if a small amount of oil has flowed, the pistons are at a high position.

After a model or pattern change, a sand quantity corresponding to the changed model is filled into a box F. The position of the multipistons or of the block squeeze head H is recorded during compacting by recording the quantity of flowed oil. The height of the molding pistons at the end of the pressing process is detected from the quantity of flowed oil using a calibration curve (a) in the control means. The deviation with respect to the level of the molding pistons prior to the model change is counteracted by a controlled change of the sand quantity. For this purpose, a further calibration curve is used. The second calibration curve (b) results from the manufacturing process of the models obtained before or is a firmly installed dependency, e. g. as a curve or predetermined "function" from a model data base.

If, for example, the position of the pistons was too low, more sand is filled in in the next molding process. If the position of the pistons was too high, less sand is filled in in the next molding process.

The quantity of sand corresponding to the initially predetermined and subsequently changed model may also be provided by a model data base which is automatically updated during operation and stores initial values for a given mold and an actual compactibility of the molding material. The "quantity of sand corresponding to the changed model" now corresponds to the initial value from the data base; other initial values are also available, such as a manual pre-set or a maintenance of the old quantity of sand of the preceding model. In operation, a follow-up control according to the above description is effected for said initial values to be stored as a "new initial value" in the data base when the correct value is reached.

Figure 2:
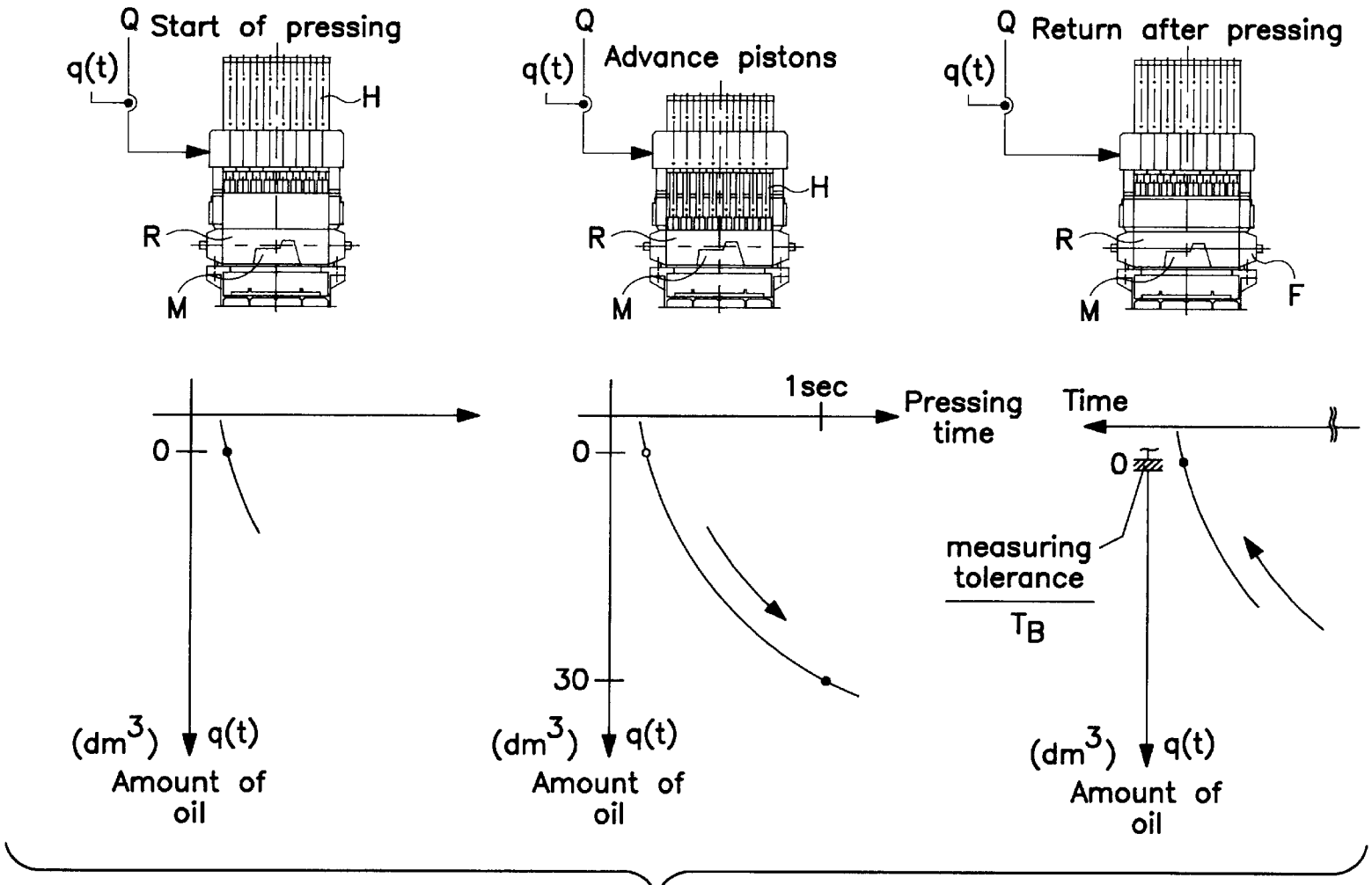

FIG. 2 illustrates the reproducibility of the piston position and shows the start of the multipistons on the left. After an oil quantity q(t) of 30 liters (for example) has flowed, the pistons have moved to their final position after one second. If the oil is returned from the molding pistons, the oil which flows back is compared with the volume of flowed oil detected until the end of pressing. A small tolerance range $T_B$ is provided to compensate for inaccuracies. If the quantity of oil flowed to and fro is not equal, an error message is provided.

The pistons are intentionally advanced and returned by a positive and negative supply, respectively, with oil.

After the multipistons have been intentionally advanced, they should be returned by the same value or a partial value thereof. To control whether this movement has been effected completely, the quantity of flowed oil or the covered height difference is recorded. The total or a part quantity is recorded. In case the returning movement was improper, an error or correction message is provided.

For example, a piston is torn-out after pressing. The quantity of returning oil does not correspond to the quantity of advanced oil. The machine has to be stopped and repaired.

The final position achieved after pressing is also compared by said reproducibility measurement. Conclusions regarding leaks in the hydraulic system or machine defects are possible.

Figure 3:
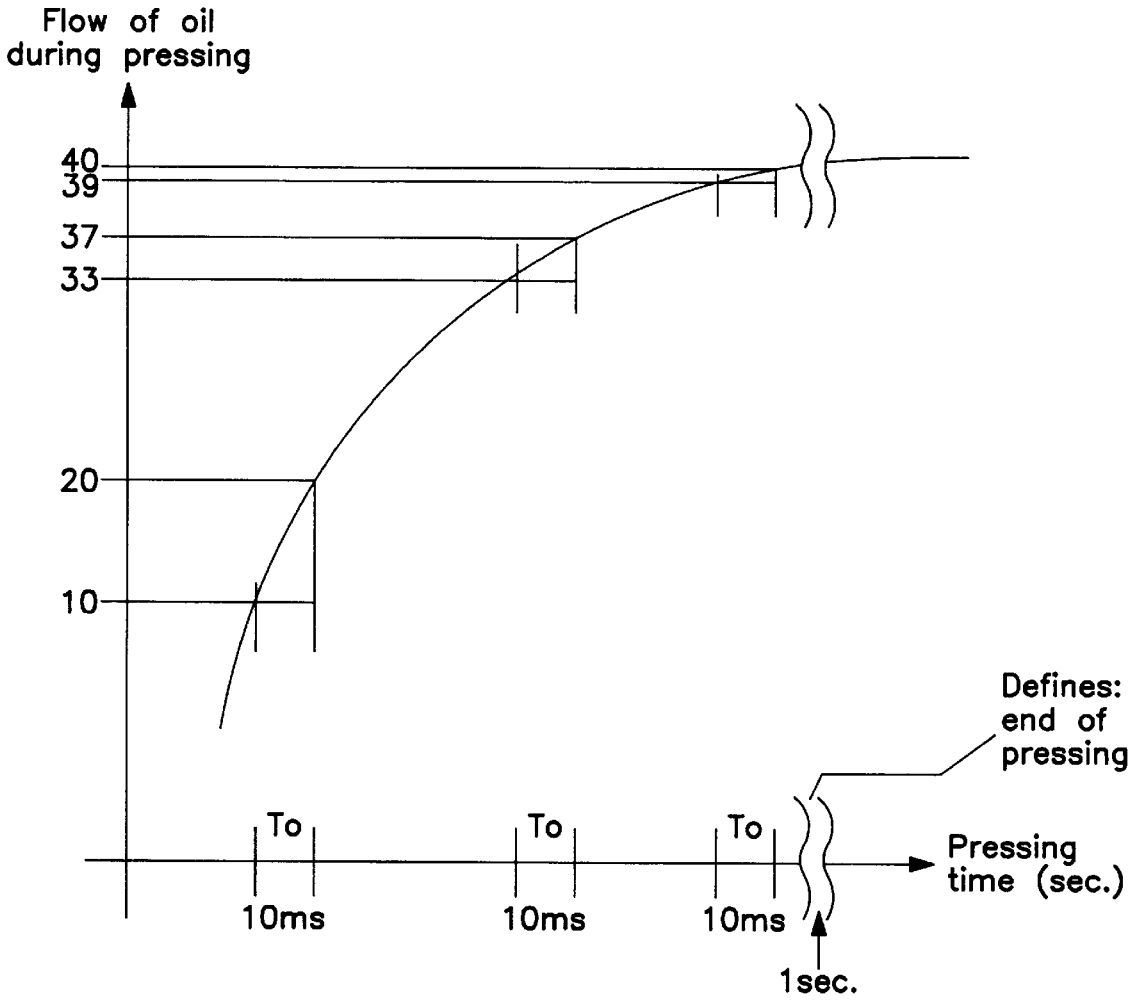

FIG. 3 illustrates a minimization of the consumption of energy and of the requirement of time.

The minimization of the required time and the minimization of the consumption of energy by measuring the flowed oil per equal interval of time $T_0$, e. g. 10 msec., is illustrated. If the oil flow over said equal interval of time achieves a predetermined (low) value or becomes zero, the measurement of the oil quantity shows that the end of the pressing process approaches or is imminent. The next step of the process control may be started immediately; delay times or passive stations are not required. FIG. 3 schematically illustrates the end of the pressing process at about one second and shows that at this moment or shortly before, the quantity of flowed oil is only small during the same 10 ms interval ($T_0$). The pressing process may be cut-off already here.

The flowed volume of hydraulic oil per time unit is controlled by a measuring system integrated in the hydraulic circuit. "End of pressing" designates the situation when the flowed volume per time unit approaches zero. The course of the pressing process may be recorded with moving multipistons via curves stored in the control means.

For the information end of pressing="cutting-off pressure" the corresponding signal from the actual value flowed volume per time unit is compared with respect to a desired value or zero, and the molding pressure is switched off.

The process may immediately be cut off at a determined moment or if the flowed volume per time unit is "about" zero, and the following movement step may be initiated. The cycle time of the machines is shortened, the consumption of energy is optimized and reduced.

Figure 4:
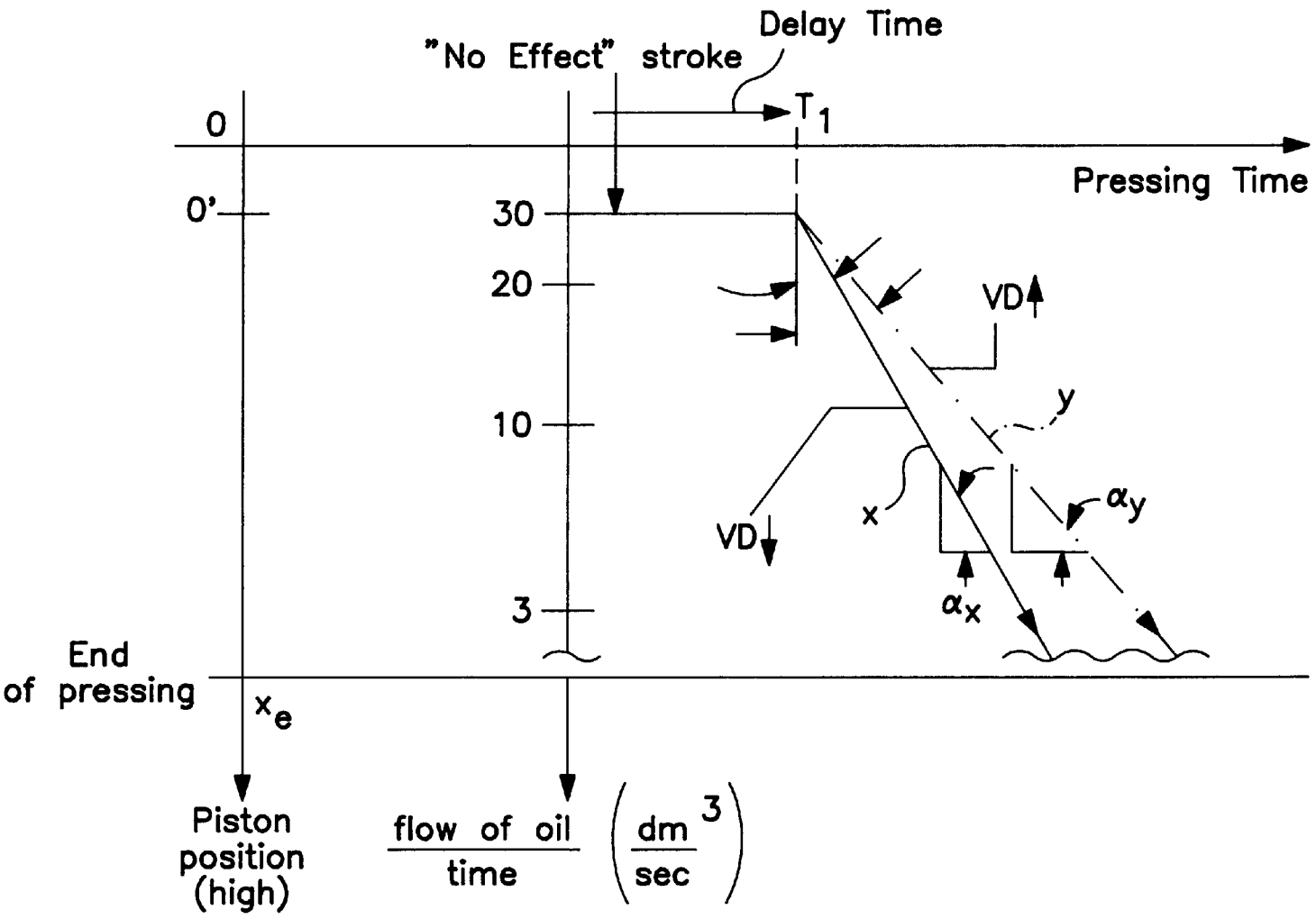

FIG. 4 represents a correction of the compactibility (VD) and shows two gradients x,y having a slope $\alpha$ (=alpha). The gradients are shown for sand of high compactibility (normal alpha, $alpha_y$) and for sand of low compactibility (high alpha, $alpha_x$), wherein $alpha_x > alpha_y$. Both diagrams show the change of the oil flow per time, the beginning of each slope (of the gradient) characterizing the moment at which the pistons contact the molding sand.

Providing sand with low compactibility (with high piled weight), said contact happens comparably late, the filling level of the sand being comparably low. Accordingly, the pistons meet with resistance only late, however, they then meet with a stronger resistance, which is shown by the high gradient. In contrast thereto, sand with higher compactibility, which presents a weaker decrease of the oil flow per time unit, however, a comparably early beginning of said change. At the end of the pressing process, both gradients meet at the same point, namely at an oil flow of zero.

In FIG. 4, the starting point of the gradients x,y is displaced to the same point with a different slope of the q'(t) function, to illustrate the different slopes (gradients). In fact the end would be the same with a considerably displaced beginning.

On the basis of the different gradients, a measured value for the change of the compactibility by adding more water or less water in the mixer which provides the molding sand, may be provided and thus, a correction of the compactibility may be established always permitting equal compactibility without measuring the compactibility itself, but instead, only the gradient of the oil flow to the individual pistons.

It is supposed that the same model is formed and an equal sand volume is filled in. Molding material with deviating compactibility is supplied due to differences in the preparation of said molding material.

In fact, the level of sand with a low compactibility is relatively low, whereas the level of highly compactible sand is relatively high in the molding box.

Providing sand with a relatively high compactibility, the time interval $T_1$ until the multipiston meets with resistance (delay time, dead stroke) is relatively short; providing sand with a low compactibility (high piled weight), said interval is comparably long.

For sand with low compactibility, the function "flowed volume per time unit" according to FIG. 4 is steep, for highly compactible sand (VD with arrow in upward direction, as shown in FIG. 4 at function y), the function "flowed volume per time unit" is comparably flat. The functions of the gradients "flowed volume per time unit" with respect t o time are recorded. The control which is caused according to this velocity function, is an adaptation of the quantity of sand filled in or a long-term (with a delay of several mixtures) follow-up control of the compactibility in the preparation of sand. The latter is achieved by changing the moisture or by adapting the addition of additives to the molding material.

A too steep drop or descent of the "flowed volume per time unit" for example designates a too low compactibility. More sand is filled in (on a short-term basis), the amount of moisture (compactibility) is increased (on a long-term basis) by controlling the water in the mixer, to increase compactibility. This is valid vice versa in case of a too weak descent per time (less water in the mixer).

A change of the addition of additives as fines or their composition m ay also serve to control the physical properties of the molding material. Binders such as bentonite or lustros carbon formers such as powdered coal, bitumen, oils may be used as additives; depending on the application. In most cases, said additives are of granular nature, e. g. also starch or wood meal which are mixed with water to obtain fines to be added (in moist condition). If an addition of dry additive s is preferred when preparing the sand, they may be added separately from the water.

For information purposes it is mentioned, that the pistons H do not simultaneously contact the molding sand when they are advanced (dead stroke and delay time), and that they penetrate into the molding sand at different speeds. FIG. 4 is a simplified illustration according to which equal filling height was supposed so that for low and high compactibility (VD), both gradients start to drop at the same moment $T_1$; in other words, the two functions x and y are represented to be displaced towards each other in direction of "dead stroke" and delay time to permit a better graphic comparison of the curved ($1/x, e^{-x}$) functions. In practice, differently compactible sands (with different piled weights) also have different filling levels, solely due to the filling operation into the molding box F and the filling frame despite equal mass.

In general, the following applies:

| | | |
|---|---|---|
| piled weight | high | low |
| compactibility VD | low | high |
| flowability | high | low |
| possible pressing courses | short | long |
| filling height | low level | high level |

The result of the integral with respect to the functions x or y (integral over x" dt, from 0 until end of pressing) in case of non displaced function yields the entire oil quantity q flowed during pressing, which quantity is different for x and y.

An aggregate control in a molding equipment is described without Figure.

The supplied aggregates in said equipment are controlled to obtain a consumption of oil which is always substantially the same. The storage volumes decrease. The aggregates get smaller. The consumptions of oil minimize. Consumption peaks are avoided and do no longer need to be buffered.

A number of consumptions are controlled through a measuring arrangement in the hydraulic cylinder. With respect to the control requirement, their control commands are released, so that the (oil pressure)/(time unit) is substantially constant for the complete equipment consisting of several compacting machines.

We claim:

1. Method for influencing the quality of molds made of a molding material, which molds are obtained by a compacting process in a means for molding material compacting having a compacting unit controllable by a hydraulic fluid and molding material being conveyed to said compacting unit, said hydraulic fluid having a volume and a mass flowing to and fro with respect to the compacting unit, in which method (a) at least one of the volume and the mass of said hydraulic fluid being measured and one of the measured value directly and a derivative value thereof being used for a control in said compacting means;

(b) at least one of said volume, said mass and said derivative value thereof changes by control at least one of a parameter of said molding material and said compacting process.

2. The method of claim 1, comprising at least one of the following steps:

(a) changing a quality of said molding material filled in one of a filling frame and a molding box, prior to the compacting process;

(b) said compacting unit is provided with pistons and one of switching off said compacting unit and providing an error message, when a measured hydraulic fluid volume upon returning said pistons to a reference position is detected not to be substantially equal to a volume flowed to the pistons during the compacting process;

(b') said compacting unit is provided with pistons and one of switching off said compacting unit and providing an error message when a measured hydraulic fluid mass upon returning said pistons to a reference position is detected not to be substantially equal to a mass flowed to the pistons during the compacting process;

(c) comparing one of a measured and a calculated flow value volume of fluid per time unit with one of a zero and a small reference value to detect the end of the compacting process;

(c') comparing one of a measured and a calculated mass value of fluid per time unit with one of a zero and small reference value to detect the end of the compacting process;

(d) changing a compactibility of said molding material conveyed to said compacting unit dependent on a gradient of a flow value of said hydraulic fluid, said flow value being one of volume per time and mass per time of said hydraulic fluid.

3. The method of claim 1, wherein one of the change of the hydraulic fluid volume over time, the hydraulic fluid mass over time and the derivative thereof is used to change the compactibility of molding material conveyed to said compacting unit.

4. The method of claim 3, wherein the compactibility of the molding material is changed by changing the addition of one of water, additives or compounds thereof.

5. The method of claim 4, wherein said additives comprise one of bentonite, lustros carbon formers, starch, fines.

6. The method of claim 2, wherein a reference value is selected to give sufficient hardness to the mold of molding material with shortest possible compacting time.

7. The method of claim 3, wherein said change is used on a long-term basis as an actuating influence for controlling said molding material conveyed to be molded.

8. The method of claim 1, wherein one of said hydraulic fluid volume, mass and the determination of the derivative value thereof is integrated in said compacting unit or is associated to it.

9. The method of claim 2, wherein a change in the supply of molding material quantity is activated only after a preceding pattern change has occurred.

10. The method of claim 1, said compacting unit comprising a plurality of pistons and all said pistons being coupled to a common source of said hydraulic fluid and one of a volume- and a mass- per time- measuring device being provided in a supply line to said pistons.

11. The method of claim 2, said compacting unit comprising pistons driven by said hydraulic fluid and at least two calibration curves are used for changing said molding material quantity, one of said calibration curves defining dependency of the piston position on the hydraulic fluid volume and the other one defining a dependency of one of said molding material quantity and difference thereof on said hydraulic fluid volume.

12. The method of claim 1, said hydraulic fluid substantially being oil.

13. The method of claim 1, said measured value and the derivative value thereof being used for feed-forward or feed-backward control in said compacting means.

14. The method of claim 1, said molding material being a molding sand.

15. The method of claim 1, said hydraulic fluid being measured in a molding machine as compacting means.

16. The method of claim 1, said derivative value being a difference of measured values spaced apart in time.

17. The method of claim 1, said derivative value being at least a first derivative of a function established by succeeding measured values over time.

18. Method for influencing a quality of a mold made from a molding material, which mold is obtained in a compacting process by a means for molding material compacting having a plurality of pistons as a compacting unit, the pistons being controllable by a hydraulic fluid having a volume and a mass, in which method said molding material is conveyed to said compacting unit for compacting by the plurality of pistons, (a) at least one of the volume, the mass and a derivative thereof being measured and one of the measured value directly and a derivative thereof being used for a control in said compacting means;

(b) at least one of said volume, the mass and a derivative changes by control at least one parameter of at least one of said molding material and said compacting process.

* * * * *